US008320592B2

(12) United States Patent
Kim

(10) Patent No.: US 8,320,592 B2
(45) Date of Patent: Nov. 27, 2012

(54) APPARATUS AND METHOD OF REPRODUCING VIRTUAL SOUND OF TWO CHANNELS BASED ON LISTENER'S POSITION

(75) Inventor: Sun-min Kim, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1390 days.

(21) Appl. No.: 11/641,067

(22) Filed: Dec. 19, 2006

(65) Prior Publication Data

US 2007/0154019 A1 Jul. 5, 2007

Related U.S. Application Data

(60) Provisional application No. 60/752,409, filed on Dec. 22, 2005.

(30) Foreign Application Priority Data

Feb. 24, 2006 (KR) ..... 10-2006-0018428

(51) Int. Cl.
*H04R 5/02* (2006.01)

(52) U.S. Cl. ..... 381/310; 381/17; 381/18; 381/19; 381/27; 381/300; 381/307

(58) Field of Classification Search ..... 381/17, 381/309, 310, 18, 19, 27, 61, 93, 300, 307
See application file for complete search history.

(56) References Cited

U.S. PATENT DOCUMENTS

2004/0032960 A1 2/2004 Griesinger
2005/0135643 A1 6/2005 Lee et al.
2006/0045294 A1 * 3/2006 Smyth ..... 381/309
2006/0062410 A1 3/2006 Kim et al.

FOREIGN PATENT DOCUMENTS

| | | |
|---|---|---|
| JP | 06-165079 | 6/1994 |
| JP | 2000-059898 | 2/2000 |
| KR | 10-199881 | 3/1999 |
| KR | 10-221813 | 6/1999 |
| KR | 2000-39747 | 7/2000 |
| KR | 10-2005-0056647 | 6/2005 |
| KR | 10-2005-0060789 | 6/2005 |
| KR | 10-2006-0026730 | 3/2006 |
| WO | WO 99/49574 | 9/1999 |

OTHER PUBLICATIONS

KR Notice of Allowance issued May 31, 2007 in KR Patent Application No. 10-2006-0018428.

* cited by examiner

*Primary Examiner* — Xu Mei
*Assistant Examiner* — Paul Kim
(74) *Attorney, Agent, or Firm* — Stanzione & Kim, LLP

(57) ABSTRACT

An apparatus and method of reproducing a virtual sound of two channels which adaptively reproduces a 2-channel stereo sound signal reproduced through a recording medium such as DVD, CD, or MP3 player etc., based on a listener's position. The method includes sensing a listener's position and recognizing distance and angle information about the listener's position, determining output gain values and delay values of two speakers based on the distance and angle information about the sensed listener's position and selecting localization filter coefficients in a predetermined table, and updating filter coefficients of a localization filter based on the selected localization filter coefficients and adjusting output levels and time delays of the two speakers from the determined gain values and delay values.

20 Claims, 6 Drawing Sheets

APPARATUS AND METHOD OF REPRODUCING VIRTUAL SOUND OF TWO CHANNELS BASED ON LISTENER'S POSITION

CROSS-REFERENCE TO RELATED APPLICATIONS

This application claims priority under 35 U.S.C. 119 §(a) and 120 from Korean Patent Application No. 10-2006-0018428, filed on Feb. 24, 2006, in the Korean Intellectual Property Office, and U.S. Provisional Application No. 60/752,409, filed on Dec. 22, 2005, the disclosures of which are incorporated herein in their entireties by reference.

BACKGROUND OF THE INVENTION

1. Field of the Invention

The present general inventive concept relates to a virtual sound generation system, and more particularly, to an apparatus and method of reproducing a virtual sound of two channels which adaptively reproduces a 2-channel stereo sound signal reproduced through a recording medium such as DVD, CD, or MP3 player etc., based on a listener's position.

2. Description of the Related Art

In general, a virtual sound reproduction system provides a surround sound effect such as a 5.1 channel system, using only two speakers.

Technology related to this virtual sound generation is disclosed in WO 99/49574 (PCT/AU 99/00002, filed on 6 Jan. 1999, entitled, "AUDIO SIGNAL PROCESSING METHOD AND APPARATUS").

In a conventional virtual sound generation system, a multi-channel audio signal is down-mixed as a 2-channel audio signal using a head related transfer function (HRTF).

Referring to FIG. 1, a 5.1-channel audio signal is input. 5.1-channel includes a left front channel, a right front channel, a center front channel, a left surround channel, a right surround channel, and a low frequency effect (LFE) channel. Left and right impulse response functions are applied to the respective channels. Thus, a corresponding left front impulse response function 4 is convolved with a left front signal 3 with respect to a left front channel 2. The left front impulse response function 4 is an ideal spike output from a left front channel speaker located in an ideal position, and uses an HRTF as an impulse response to be received by a listener's left ear. An output signal 7 is combined with a left channel signal 10 for a headphone. Similarly, a corresponding impulse response function 5 with respect to a right ear for a right channel speaker is convolved with a left front signal 3 so as to generate an output signal 9 to be combined with a right channel signal 11. Thus, the arrangement of FIG. 2 requires about 12 convolution steps with respect to 5.1-channel signals. As such, the 5.1-channel signals are down-mixed by combining a measured HRTF, and even though they are reproduced as 2-channel signals, a surround effect as being reproduced by a multi-channel can be illustrated.

However, in the conventional virtual sound reproduction system, since a sweet spot (i.e., the ideal spot to maximize stereo-sound quality) is defined as a partial region (in general, a center point between two speakers), if a listener does not contact the sweet spot, a stereo surround-sound feeling is remarkably reduced. When the conventional virtual sound reproduction system is used in a TV, a surround-sound stereo feeling cannot be provided to a TV audience in a position that is deviated from the center point between two speakers.

SUMMARY OF THE INVENTION

The present general inventive concept provides a method and an apparatus of reproducing a 2-channel stereo sound in which an optimum virtual stereo sound is generated based on a listener's position when the listener's position is deviated from a sweet spot.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of reproducing a virtual sound by which a multi-channel audio signal is reproduced as a 2-channel output, the method including sensing a listener's position and recognizing distance and angle information about the listener's position, determining output gain values and delay values of two speakers based on the distance and angle information about the sensed listener's position and selecting localization filter coefficients in a predetermined table, and updating filter coefficients of a localization filter based on the selected localization filter coefficients and adjusting output levels and time delays of the two speakers from the determined gain values and delay values.

The sensing of the listener's position may include measuring an angle and a distance of a central position of the two speakers based on a listener.

The localization filter may use a structure in which a binaural synthesis matrix and a crosstalk canceller matrix are multiplied.

The determining of the output gain values and the delay values of the two speakers may include calculating a distance between the listener and the two speakers.

Left and right output gains and left and right delay values of the two speakers may be obtained by $g_L=r_2/r_1$, $g_R=r_1/r_2$, $\Delta_L=|\text{integer}(F_s(r_2-r_1)/c)|$, $\Delta_R=|\text{integer}(F_s(r_1-r_2/c)|$, where $r_1$ is a distance between a left speaker and a listener, $r_2$ is a distance between a right speaker and the listener, $F_s$ is a sampling frequency, c is sound velocity, and integer is an operator making an integer by rounding off to the nearest integer.

The selecting of the localization filter coefficients may include establishing a localization filter table in which a binaural synthesis matrix and a crosstalk canceller matrix are multiplied, in advance, selecting a filter type index corresponding to an angle between the two speakers and the listener, and extracting the localization filter coefficients corresponding to the filter type index.

Coefficients in which the binaural synthesis matrix and the crosstalk canceller matrix that are calculated in various positions of the listener in advance may be multiplied in advance are stored in the filter table.

The foregoing and/or other aspects and utilities of the present general inventive concept may also be achieved by providing an apparatus to reproduce a virtual sound including a position recognition system to sense a listener's position and to measure an angle and a distance between a listener and two speakers, a parameter converter to extract output gain values and delay values of two speakers from distance information extracted by the position recognition system and to determine filter type index information that matches angle information from a predetermined filter table, and a virtual sound processor to adjust output levels and time delays of two speakers from the output gain values and delay values of two speakers converted by the parameter converter and to update filter coefficients of a localization filter from filter coefficients corresponding to the filter type index information.

The parameter converter may include a geometry conversion unit to calculate a geometry relationship between the two speakers and the listener based on the distance and angle information between the two speakers and the listener, an acoustic model unit to extract output gain values and delay values of the two speakers through acoustic modeling from the distance information calculated by the geometry conversion unit, and a table matching unit to extract a filter type index to select a set of filter coefficients of the localization filter corresponding a listener's position from the angle information calculated by the geometry conversion unit and a predetermined localization filter coefficient table.

The virtual sound processor may include a filter table in which localization filter coefficients that are calculated in advance and match each of filter type indices are stored, a virtual sound generator to update filter coefficients of the localization filter from the localization filter coefficients that match the filter type index information and to convert audio signals of two channels into virtual sound sources in a predetermined position, and an output controller to adjust output levels and time delays of signals output from the virtual sound generator based on the output gain values and delay values of the two speakers.

The virtual sound generator may include a filter matrix structure in which a binaural synthesis matrix and a crosstalk canceller matrix are multiplied.

The filter table may include localization filter coefficients calculated in various positions of the listener.

The foregoing and/or other aspects and utilities of the present general inventive concept may also be achieved by providing a computer-readable recording medium having recorded thereon a program to execute a method of reproducing a virtual sound by which a multi-channel audio signal is reproduced as a 2-channel output, wherein the program controls the method according to a process including, sensing a listener's position and recognizing distance and angle information about the listener's position, determining output gain values and delay values of two speakers based on the distance and angle information about the sensed listener's position and selecting localization filter coefficients in a predetermined table, and updating filter coefficients of a localization filter based on the selected localization filter coefficients and adjusting output levels and time delays of the two speakers from the determined gain values and delay values.

The foregoing and/or other aspects and utilities of the present general inventive concept may also be achieved by providing an apparatus to implement virtual sound based on a listener's position using two speakers, the apparatus including a geometry conversion unit to calculate a geometry relationship between the two speakers and the listener based on distance and angle information between the two speakers and the listener, an acoustic model unit to extract output gain values and delay values of the two speakers through acoustic modeling from the distance information calculated by the geometry conversion unit, and a table matching unit to extract a filter type index to select a set of filter coefficients of the localization filter corresponding a listener's position from the angle information calculated by the geometry conversion unit and a predetermined localization filter coefficient table.

The apparatus may further include a filter table to store localization filter coefficients that are calculated in advance and to select at least one of the localization filter coefficients according to the filter type index, a virtual sound generator to update localization filter coefficients that match the filter type index and to convert audio signals into two channels of virtual sound sources in a predetermined position according to the updated localization filter coefficients, and an output controller to adjust output levels and time delays of signals output from the virtual sound generator based on the output gain values and delay values of the two speakers.

The apparatus may further include a virtual sound generator including a signal correction filter unit to adjust gains and time delays of a left channel signal, a center channel signal, a low frequency effect channel signal, and a right channel signal of the audio signals, a virtual surround filter unit to lower a correlation between an input left surround channel signal and an input right surround channel signal of the audio signals and to generate a virtual sound source at left and right sides of the listener, a first addition unit to add the left surround channel signal output from the virtual surround filter unit and the left channel signal output from the signal correction unit and then output an added left signal to one of the two speakers as one of the two channels, and a second addition unit to add the right surround channel signal output from the virtual surround filter unit and the right channel signal output from the signal correction unit and then output the added right signal to the other of the two speakers as the other one of the two channels.

The virtual surround filter unit may include a preprocessing filter unit to lower the correlation between the input left surround channel signal and the input right surround channel signal, to improve a localization feeling and to simultaneously generate a presence feeling, and a localization filter unit to receive signals output from the preprocessing filter unit, and dispose the virtual sound source at left and right rear sides of the listener so as to generate a surround sound stereo feeling by multiplying a crosstalk canceller matrix and a binaural synthesis matrix corresponding to various positions of the listener to establish the filter table.

The foregoing and/or other aspects and utilities of the present general inventive concept may also be achieved by providing a method of implementing virtual sound based on a listener's position using two speakers, the method including calculating a geometry relationship between the two speakers and the listener based on distance and angle information between the two speakers and the listener, extracting output gain values and delay values of the two speakers through acoustic modeling from the calculated distance information, and extracting a filter type index to select a set of filter coefficients of a localization filter corresponding a listener's position from the calculated angle information.

The foregoing and/or other aspects and utilities of the present general inventive concept may also be achieved by providing an apparatus to implement virtual sound based on a listener's position using two speakers, the apparatus including a filter table to store a plurality of localization filter coefficients that are calculated in advance and match each of a plurality of filter type indices, a virtual sound generator to design a crosstalk canceller in various predetermined positions of a listener to convert audio signals into two channels of virtual sound sources according to the filter type indices, and an output controller to adjust output levels and time delays of signals output from the virtual sound generator based on output gain values and delay values of the two speakers.

The foregoing and/or other aspects and utilities of the present general inventive concept may also be achieved by providing a method of implementing virtual sound based on a listener's position using two speakers, the method including calculating a plurality of localization filter coefficients, matching a plurality of filter type indices to the plurality of localization filter coefficients, designing a crosstalk canceller in various predetermined positions of a listener to convert audio signals of two channels into virtual sound sources according to one or more filter type indices, and adjusting output levels and time delays of output signals output based on output gain values and delay values of the two speakers.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
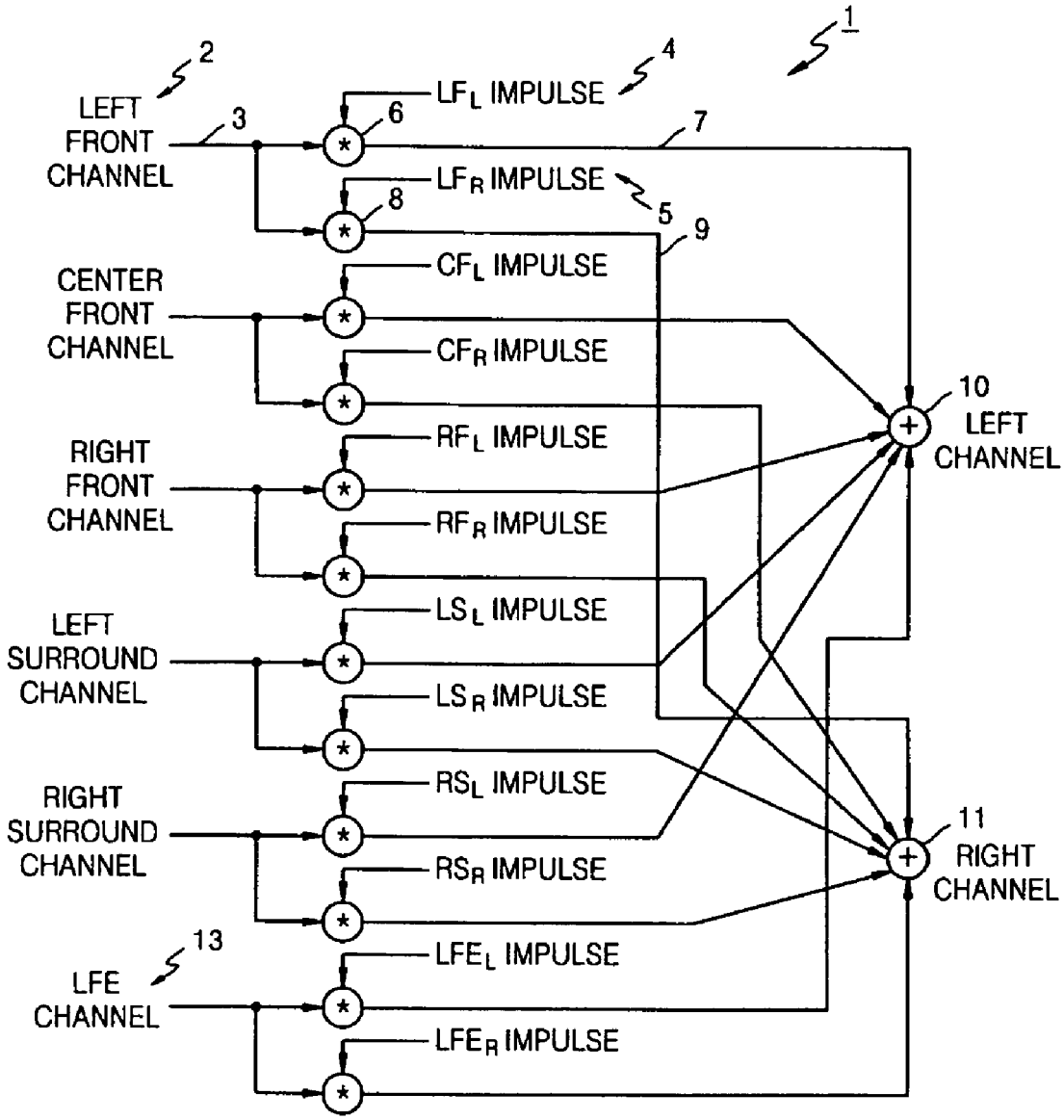
FIG. 1 (PRIOR ART)
FIG. 1 is a block diagram illustrating a conventional stereo sound generation system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Reproducing an optimized 2-channel virtual sound based on a listener's position will now be described.

Figure 2:
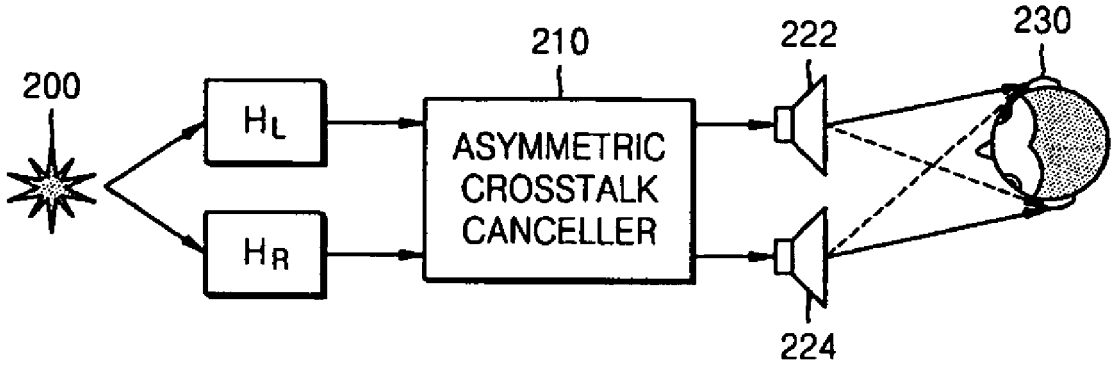
FIG. 2 is a view illustrating a crosstalk canceller that is changed based on a listener's position.

FIG. 2 is a conceptual view illustrating a crosstalk canceller that is changed based on a listener's position. Referring to FIG. 2, a sound source 200 emits sound which provides a surround-sound stereo feeling through head related transfer functions (HRTFs) ($H_L$, $H_R$) of two ears of a listener. In order to implement a virtual sound using two speakers, a crosstalk canceller filter (e.g. "asymmetric crosstalk canceller") 210 that cancels a crosstalk phenomenon between two speakers 222 and 224 and a listener 230 is required. Since the crosstalk canceller filter 210 is designed from a listener's specific position, when the listener's position changes, filter coefficients of the crosstalk canceller filter 210 should also change accordingly. Thus, a core technology of an adaptive type apparatus to reproduce a virtual sound depends on a design technology of the crosstalk canceller filter 210 based on a listener's position.

A design of the asymmetric crosstalk canceller will now be described.

A conventional crosstalk canceller is designed using four acoustic paths called HRTFs, between a speaker and two ears of a listener. The conventional crosstalk canceller is designed by performing an inverse matrix of the size of 2. When two speakers are disposed symmetrically about the listener, since a distance between the two speakers and a distance between the listener and the two speakers are the same, the conventional crosstalk canceller can be designed using the measured HRTF. However, as illustrated in FIG. 2, when the two speakers 222 and 224 are disposed asymmetrically about the listener 230, a distance between the two speakers 222 and 224 and a distance between the listener 230 and the two speakers 222 and 224 are not the same. Thus, the asymmetric crosstalk canceller cannot use the measured HRTF and is designed by adding an acoustic model to consider effects of the differing distances. The acoustic model uses a known free field model, a direct and reverberant model, etc.

Figure 3:
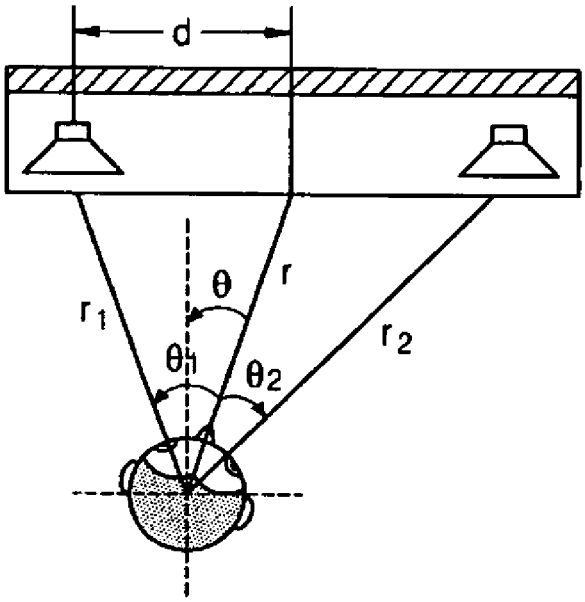
FIG. 3 is a view illustrating a geometrical relationship between two speakers and a listener.

FIG. 3 illustrates a geometrical relationship between two speakers and a listener. Referring to FIG. 3, a half of a distance between two speakers is d, a distance and an angle with respect to a position between the center point between the two speakers and the listener are r and θ, respectively, a distance between a left speaker and the listener is $r_1$, a distance between a right speaker and the listener is $r_2$, an angle formed by r and a vector $r_1$ is $\theta_1$, and an angle formed by r and $r_2$ is $\theta_2$.

As illustrated in FIG. 3, assuming the listener sees the center between the two speakers, HRTFs corresponding to a left speaker and two ears are $H_L(\theta_1)$ and $H_R(\theta_1)$, respectively, and HRTFs corresponding to a right speaker and two ears are $H_L(\theta_2)$ and $H_R(\theta_2)$, respectively. A crosstalk canceller which considers a distance between speakers may be designed using the four measured HRTFs and a free field acoustic model, as following equation 1.

$$C = H^{-1} = \begin{bmatrix} H_L(\theta_1)\frac{1}{r_1}z^{-\Delta_1} & H_L(\theta_2)\frac{1}{r_2}z^{-\Delta_2} \\ H_R(\theta_1)\frac{1}{r_1}z^{-\Delta_1} & H_R(\theta_2)\frac{1}{r_2}z^{-\Delta_2} \end{bmatrix}^{-1} \quad \text{[EQUATION 1]}$$

However, since the crosstalk canceller as defined by equation 1 should be designed based on all positions of the listener, much time and effort would be required to develop a design, and a large amount of memory would be needed to implement such a system. For example, since the crosstalk canceller as defined by equation 1 should consider all positions of the listener, the crosstalk canceller as defined by equation 1 would need several thousands to several ten thousands of filter coefficients.

Thus, a crosstalk canceller needs to be designed by separating information about an angle of the listener and information about a distance. Equation 1 can be converted into equation 2 through a simple procedure.

$$C = r_1 r_2 z^{(\Delta_1+\Delta_2)} \begin{bmatrix} \frac{1}{r_2}z^{-\Delta_2} & 0 \\ 0 & \frac{1}{r_1}z^{-\Delta_1} \end{bmatrix} \begin{bmatrix} H_L(\theta_1) & H_L(\theta_2) \\ H_R(\theta_1) & H_R(\theta_2) \end{bmatrix}^{-1} \quad \text{[EQUATION 2]}$$

In equation 2, time delays ($\Delta_1$, $\Delta_2$) are calculated using distances ($r_1$, $r_2$) between two speakers, a sampling frequency Fs, and a sound wave speed c (343 m/s), as the following equation 2, where int( ) is an operator to form an integer.

$$\Delta_1 = \mathrm{int}\left(\frac{r_1 Fs}{c}\right),\ \Delta_2 = \mathrm{int}\left(\frac{r_2 Fs}{c}\right) \quad \text{[EQUATION 3]}$$

Thus, as illustrated in equation 2, the crosstalk canceller C can be separated into a matrix represented by a distance and an inverse matrix represented by an HRTF, which is an angular function.

Calculation of the matrix represented by the distance of the separated two matrices is not complicated and thus the matrix represented by the distance can be calculated in real-time. A gain value and a delay value to determine an output level of two speakers and a time delay are calculated from equations 2 and 3. Thus, the output level and the time delay are adjusted by multiplying the gain value and the delay value by a signal right before a final output value of two speakers.

Since it is difficult to calculate the inverse matrix of the HRTF in real-time, the inverse matrix of the HRTF is designed in advance and is designed in a look-up table format. Thus, a lookup table can search for an inverse matrix corresponding to a listener's position, and can apply the inverse matrix corresponding to the listener's position to the crosstalk canceller. In general, most listeners' positions can be expressed only by several to several tens of HRTF inverse matrices.

Figure 4:
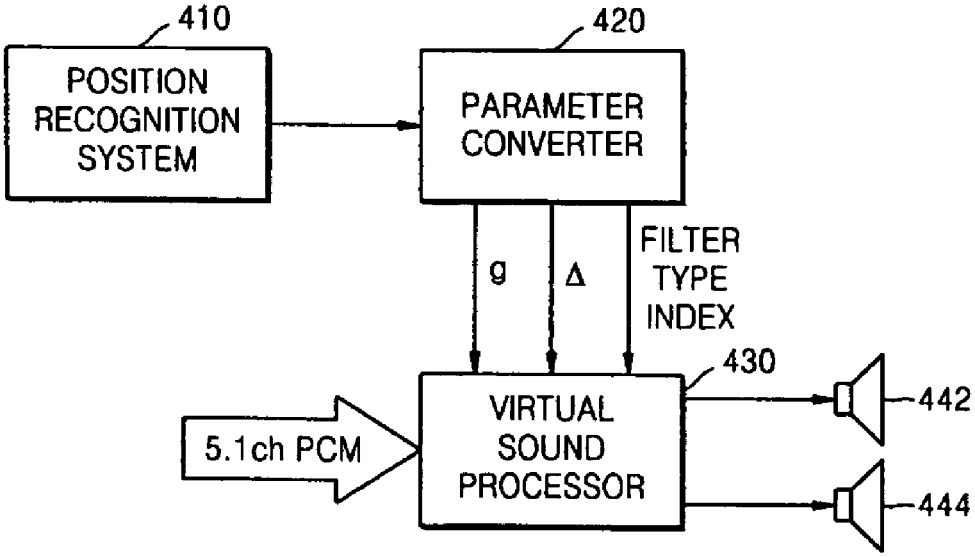
FIG. 4 is a block diagram illustrating an apparatus to reproduce a virtual sound according to an embodiment of the present general inventive concept.

FIG. 4 is a block diagram illustrating an apparatus to reproduce a virtual sound according to an embodiment of the present general inventive concept. The apparatus to reproduce the virtual sound includes a position recognition system 410, a parameter converter 420, and a virtual sound processor 430.

Referring to FIG. 4, the apparatus to produce the virtual sound generates a virtual sound of two channels by a received PCM sound input of a 5.1 channel. A conventional apparatus to reproduce a virtual sound is designed with respect to a listener's specific position. Thus, if a listener is not located in the specific position, a surround-sound stereo feeling is remarkably reduced.

The position recognition system 410 recognizes a listener's position. The position recognition system 410 can use well-known technology, and the present general inventive concept is not limited to a specific method. As an example, the listener's position can be recognized using a camera or an ultrasonic sensor. Only an assumption that position information (distance and angle) about a listener's horizontal plane is recognized by the position recognition system 410 is made.

The parameter converter 420 converts the position information (distance and angle) of the listener recognized by the position recognition system 410 into a parameter format that requires the virtual sound processor 430. That is, the parameter converter 420 generates a gain value g, a delay value Δ, and filter type index information using the position information (distance and angle) of the listener.

The virtual sound processor 430 generates a virtual sound of two channels by a received PCM sound input of a 5.1 channel. In particular, the virtual sound processor 430 adjusts an output level of two speakers 442 and 444 and a time delay using the output gain value g and the delay value Δ between two speakers converted by the parameter converter 420, and updates filter coefficients of a localization filter using filter type index information.

Figure 5:
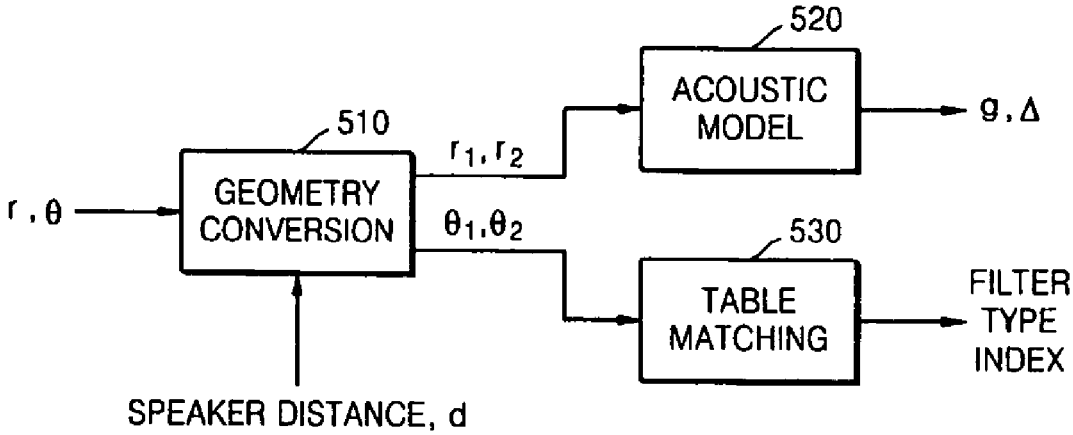
FIG. 5 is a detailed diagram illustrating a parameter converter of the apparatus of FIG. 4.

FIG. 5 is a detailed diagram illustrating the parameter converter 420 of FIG. 4. Referring to FIG. 5, the parameter converter 420 includes a geometry conversion unit (e.g. geometry conversion) 510, an acoustic model unit (e.g. acoustic model) 520, and a table matching unit (e.g. table matching) 530. The geometry conversion unit 510 calculates a geometric relationship between two speakers and a listener by adding distance information d between two speakers to position information r and θ of a listener.

The acoustic model unit 520 calculates the gain value g, for example left and right gain values ($g_L$, $g_R$), and the delay value Δ, for example left and right delay values ($\Delta_L$,$\Delta_R$), of outputs of two speakers from distance information ($r_1$, $r_2$) between the two speakers and the listener using an acoustic model. Equation 4 represents a procedure of calculating a geometric relationship between the two speakers and the listener and the gain values ($g_L$, $g_R$) and the delay values ($\Delta_L$,$\Delta_R$) of the outputs of the two speakers using the geometry conversion and the acoustic model.

$$y = r\cos\theta,\ x = r\sin\theta \quad \text{[EQUATION 4]}$$

$$\phi_1 = \tan^{-1}\left(\frac{x+d}{y}\right),\ \phi_2 = \tan^{-1}\left(\frac{x-d}{y}\right)$$

$$\theta_1 = \theta - \phi_1,\ \theta_2 = \theta - \phi_2$$

$$r_1 = \frac{y}{\cos\phi_1},\ r_2 = \frac{y}{\cos\phi_2}$$

$$\text{if } \theta > 0$$

$$g_L = 1,\ \Delta_L = 0$$

$$g_R = \frac{r_2}{r_1},\ \Delta_R = \mathrm{int}\left(\frac{(r_1 - r_2)Fs}{c}\right)$$

$$\text{if } \theta < 0$$

$$g_L = \frac{r_1}{r_2},\ \Delta_L = \mathrm{int}\left(\frac{(r_2 - r_1)Fs}{c}\right)$$

$$g_R = 1,\ \Delta_R = 0$$

The table matching unit 530 determines a filter type index value to select a filter coefficient set corresponding to position information (angle) of a listener at a look-up table of a crosstalk canceller designed in advance. The following are examples of three type indices.

$\theta_1$=5°, $\theta_2$=5°, Type index (1)

$\theta_1$=5°, $\theta_2$=10°, Type index (2)

$\theta_1$=5°, $\theta_2$=15°, Type index (3)

Figure 6:
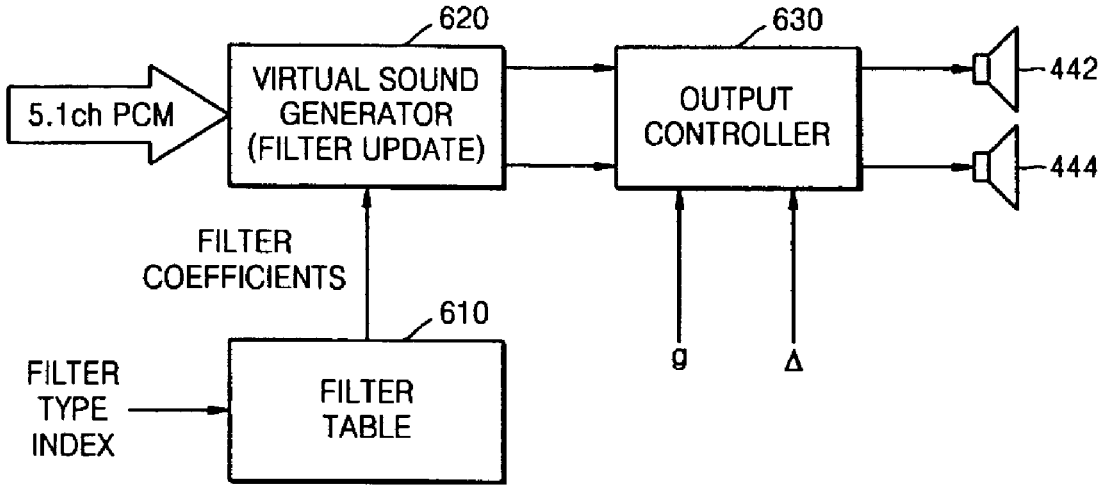
FIG. 6 is a detailed diagram illustrating a virtual sound processor of the apparatus of FIG. 4.

FIG. 6 is a detailed diagram illustrating the virtual sound processor 430 of FIG. 4. Referring to FIG. 6, the virtual sound processor 430 includes a filter table 610, a virtual sound generator 620, and an output controller 630. The filter table 610 includes localization filter coefficients corresponding to each of filter type indices determined by the parameter converter 420. In this case, the localization filter coefficients are selected by the filter table 610.

The virtual sound generator 620 updates filter coefficients of a localization filter using the filter coefficients selected by the filter table 610 and generates left and right output signals from an input 5.1-channel PCM sound as a virtual sound.

The virtual sound generator 620 may have a structure in which a finite impulse response (FIR) filter is used to localize a sound source. When a binaural synthesis portion and a crosstalk canceller are separated from each other, the virtual sound generator 620 designs a crosstalk canceller in various positions of a listener in advance, establishes a filter table and uses filter coefficients corresponding to a listener's position. In addition, when the binaural synthesis portion and the crosstalk canceller are multiplied, the virtual sound generator 620 multiplies a crosstalk canceller matrix and a binaural synthesis matrix corresponding to the various positions of the listener in advance, established a filter table and uses filter coefficients corresponding to a corresponding position of the listener.

The output controller 630 adjusts a level of a signal output from the virtual sound generator 620 and a time delay using the gain value g calculated by the parameter converter 420 and the delay value (Δ). The output controller 630 adjusts an output level of two speakers and a time delay to generate adjusted left and right output signals.

Figure 7:
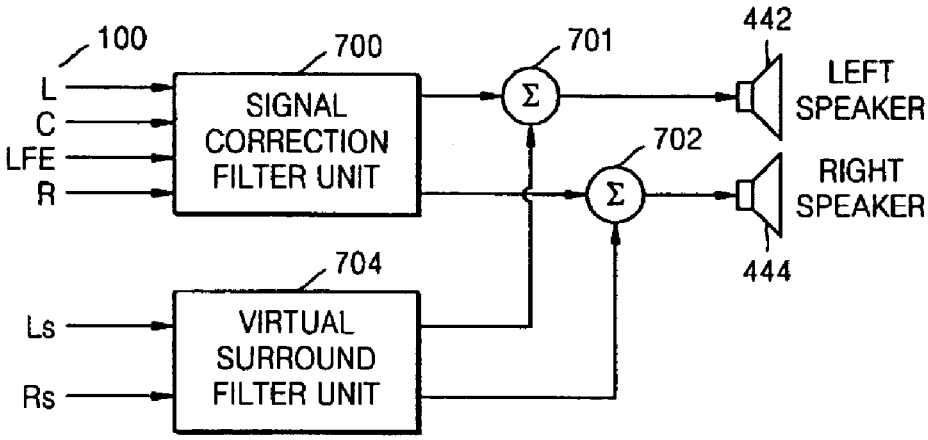
FIG. 7 is a view illustrating the virtual sound generator of FIG. 6.

FIG. 7 illustrates the virtual sound generator 620 of FIG. 6.

Referring to FIG. 7, a multi-channel audio signal 100 includes a left channel signal (L), a center channel signal (C), a low frequency effect channel signal (LFE), a right channel signal (R), a left surround channel signal (Ls), and a surround channel signal (Rs). In the present embodiment of the present general inventive concept, a 5.1 channel has been described, but the present general inventive concept can be applied to a multi-channel such as a 6.1 channel and a 7.1 channel. The multi-channel audio signal 100 may be a 5.1 channel signal. The virtual sound generator 620 includes a signal correction filter unit 700, a virtual sound filter unit 704, and first and second addition units 701 and 702.

The virtual surround filter unit 704 inputs a left surround channel signal (Ls) and a right surround channel signal (Rs) of multi-channel audio signals.

The virtual surround filter unit 704 lowers a correlation between input left and right surround channel signals, simultaneously generates a presence feeling, and generates a virtual sound source at left and right rear sides of the listener.

The signal correction filter unit 700 inputs a left channel signal (L), a center channel signal (C), a low frequency effect channel signal (LFE), and a right channel signal (R).

At this time, output gains of the left and right surround channel signals output from the virtual surround filter unit 704 are changed and time delays thereof occur. Thus, the signal correction filter unit 700 adjusts gains and time delays of the left channel signal (L), the center channel signal (C), the low frequency effect channel signal (LFE), and the right channel signal (R) according to the output gains and the time delays of the left and right surround channel signals.

The first and second addition units 701 and 702 add left channel signals output from the virtual surround filter unit 704 and the signal correction unit 700 and add right channel signals output from the virtual surround filter unit 704 and the signal correction unit 700. Then, the added left signal is output to the left channel speaker 442 and the added right signal is output to the right channel speaker 444 thought, for example, the output controller 630 as the left and right output signals.

Figure 8:
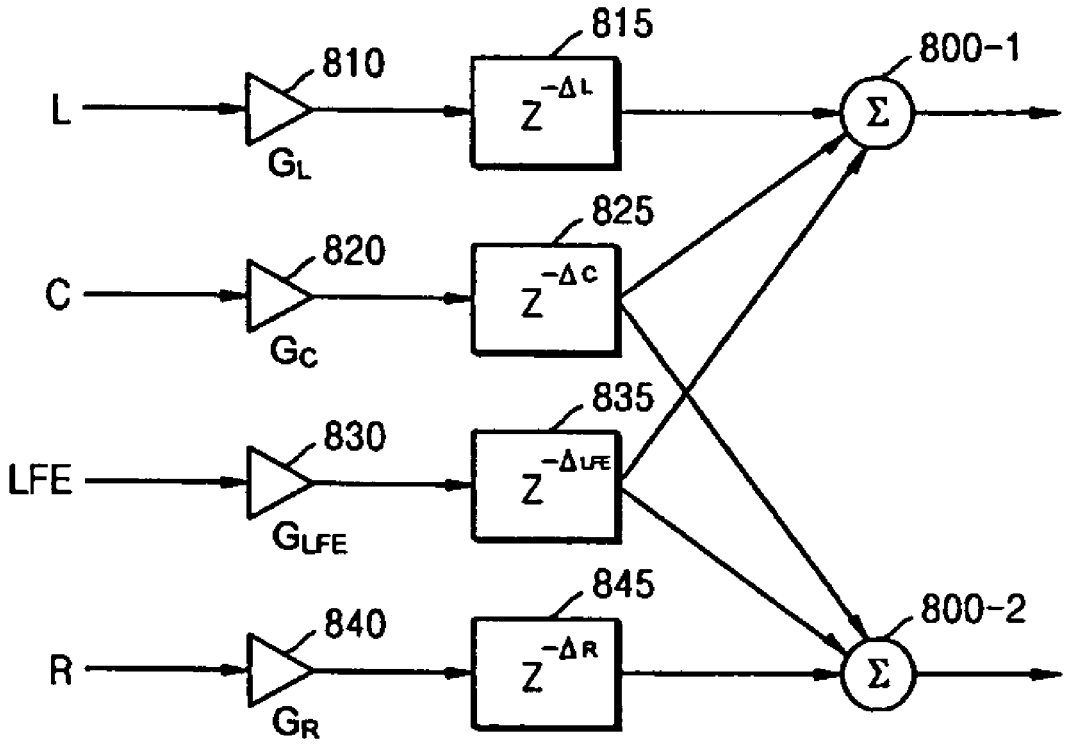
FIG. 8 is a view illustrating a signal correction filter unit of the virtual sound generator of FIG. 7.

FIG. 8 illustrates the signal correction filter unit 700 of FIG. 7

Referring to FIG. 8, an output gain of the left channel signal (L) is changed through a gain unit 810 and the left channel signal (L) is delayed by a delay unit 815. A left output signal yL from output controller 630 of FIG. 6 may represent $G_L \cdot Z^{-\Delta^L}$, where $G_L$ is a left gain unit and $Z^{-\Delta^L}$ is a left delay unit.

An output gain of the center channel signal (C) is changed through a gain unit 820 and the center channel signal (C) is delayed by a delay unit 825. A center output signal yC from output controller 630 of FIG. 6 may represent $G_C \cdot Z^{-\Delta^C}$, where $G_C$ is a center gain unit and $Z^{-\Delta^C}$ is a center delay unit.

An output gain of the low frequency effect channel signal (LFE) is changed through a gain unit 830 and the low frequency effect channel signal (LFE) is delayed by a delay unit 835. A low frequency effect output signal yLFE from output controller 630 of FIG. 6 may represent $G_{LFE} \cdot Z^{-\Delta^{LFE}}$, where $G_{LFE}$ is a low frequency effect gain unit and $Z^{-\Delta^{LFE}}$ is a low frequency effect delay unit.

An output gain of the right channel signal (R) is changed through a gain unit 840 and the right channel signal (R) is delayed by a delay unit 845. A right output signal yR from output controller 630 of FIG. 6 may represent $G_R \cdot Z^{-\Delta^R}$, where $G_R$ is a right gain unit and $Z^{-\Delta^R}$ is a right delay unit.

A first adding-up unit 800-1 adds up signals output from the delay units 815, 825, and 835. A second adding-up unit 800-2 adds up signals output from the delay units 825, 835, and 845.

Figure 9:
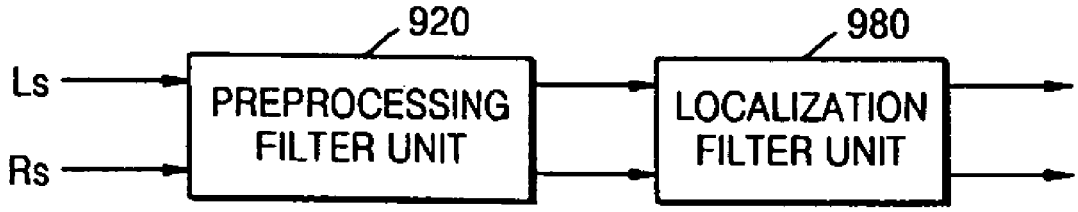
FIG. 9 is a view illustrating a virtual surround filter unit of the virtual sound generator of FIG. 7.

FIG. 9 illustrates the virtual surround filter unit 704 of FIG. 7.

Referring to FIG. 9, the virtual surround filter unit 704 includes a preprocessing filter unit 920 and a localization filter unit 980.

The preprocessing filter unit 920 lowers a correlation between an input left surround channel signal (Ls) and an input right surround channel signal (Rs), improves a localization feeling of a surround channel sound and simultaneously, generates a presence feeling. When a correlation between a left surround channel signal and a right surround channel signal is high due to front and/or back confusion, a sound image may move forward to a front side again, making it difficult to feel a surround-sound effect. Thus, the preprocessing filter unit 920 lowers the correlation between the left and right surround channel signals (Ls, Rs), and generates a presence feeling so that a natural surround channel effect can be generated.

The localization filter unit 980 uses a 2 matrix structure in which a binaural synthesis matrix and a crosstalk canceller matrix are multiplied in advance so as to reproduce a virtual sound. The localization filter unit 980 receives signals output from the preprocessing filter unit 920, disposes a virtual sound source at the left/right rear sides of the listener and generates a surround-sound stereo feeling. At this time, the localization filter unit 980 multiplies the crosstalk canceller matrix and the binaural synthesis matrix corresponding to various positions of the listener in advance and establishes a filter table.

Figure 10:
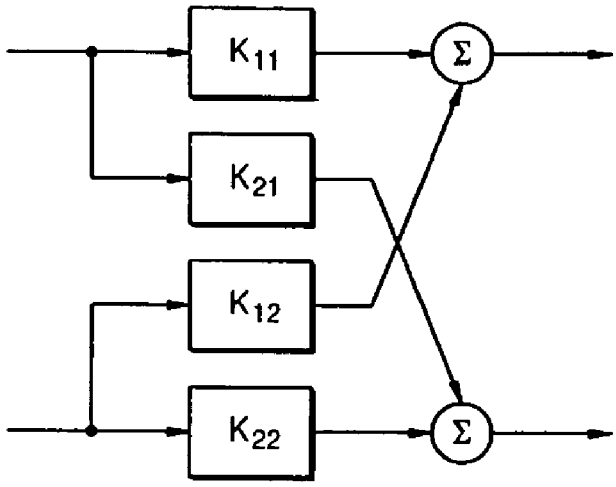
FIG. 10 is a view illustrating a localization filter unit of the virtual sound filter unit of FIG. 9.

FIG. 10 illustrates the localization filter unit 980 of FIG. 9.

Referring to FIG. 10, the localization filter unit 980 converts the left surround channel signal (Ls) and the right surround channel signal (Rs) output from the preprocessing filter unit 920 into a virtual sound source at left and right rear sides of a listener.

The localization filter unit 980 convolves the left surround channel signal (Ls) and the right surround channel signal (Rs) output from the preprocessing filter unit 220 with respect to four finite impulse response (FIR) filters ($K_{11}$, $K_{12}$, $K_{21}$, $K_{22}$) and the left surround channel signal (Ls) and the right surround channel signal (Rs) are added to each other.

After the left surround channel signal (Ls) is convolved with respect to the FIR filter ($K_{11}$) and the right surround channel signal (Rs) is convolved with respect to the FIR filter ($K_{12}$), the two signals (Ls) and (Rs) are added to each other so that a left channel output signal can be generated. After the left surround channel signal (Ls) is convolved with respect to the FIR filter ($K_{21}$) and the right surround channel signal (Rs) is convolved with respect to the FIR filter ($K_{22}$), the two signals (Ls) and (Rs) are added to each other so that a right channel output signal can be generated.

Thus, the four FIR filters ($K_{11}$, $K_{12}$, $K_{21}$, $K_{22}$) are replaced by filter coefficients that are pre-determined according to position information of the listener using a look-up table.

Figure 11:
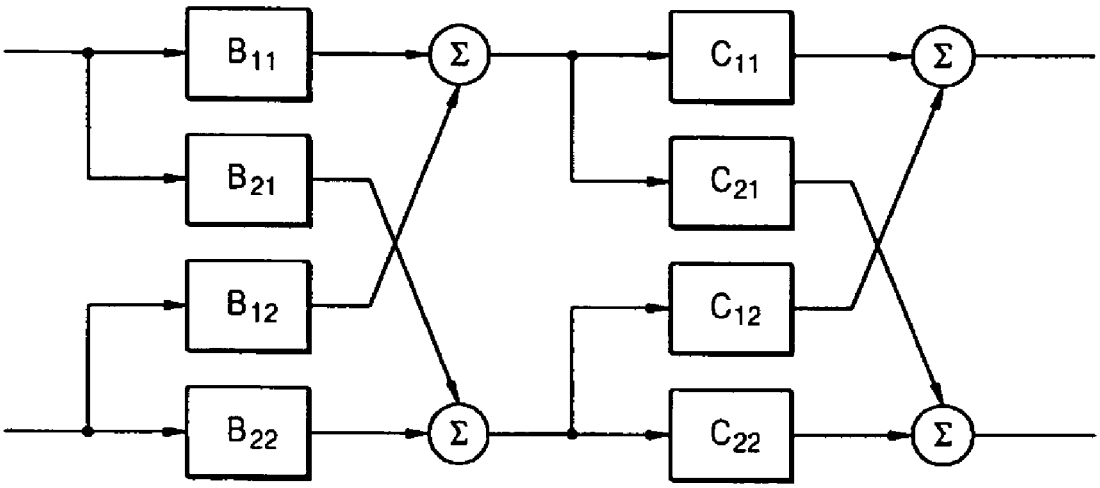
FIG. 11 is a design block diagram illustrating the localization filter unit of FIG. 9.

FIG. 11 is a design block diagram illustrating the localization filter unit 980 of FIG. 9.

Referring to FIG. 11, the localization filter unit 980 is calculated by binaural synthesis filter units ($B_{11}$, $B_{12}$, $B_{21}$, $B_{22}$) implemented as HRTF matrix between a virtual sound source and a virtual listener and by crosstalk cancelling filter units ($C_{11}$, $C_{12}$, $C_{21}$, $C_{22}$) implemented as an inverse matrix of the HRTF matrix between the virtual listener and two channel output positions.

The binaural synthesis filter units ($B_{11}$, $B_{12}$, $B_{21}$, $B_{22}$) are a filter matrix that localizes a virtual speaker into positions of a left surround speaker and a right surround speaker, and the crosstalk canceling filter units ($C_{11}$, $C_{12}$, $C_{21}$, $C_{22}$) are a filter matrix that cancels crosstalk between two speakers and two ears. Thus, a matrix K(z) of the localization filter unit 980 is calculated by multiplying the binaural synthesis matrix and the crosstalk canceller matrix.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present general inventive concept can be easily construed by programmers skilled in the art to which the present general inventive concept pertains.

According to the present general inventive concept as described above, even though a listener hears a sound input of a 5.1 channel (or more than a 7.1 channel) through 2-channel speakers, a surround-sound stereo feeling as if the listener hears the sound input through a multi-channel speaker system can be generated. In addition, in a conventional virtual sound system, when a listener is not located in a specific position, the surround-sound stereo feeling is remarkably reduced, whereas according to the present general inventive concept, an optimised stereo sound is reproduced based on a listener's position such that the listener can feel an optimised surround-sound stereo feeling even though the listener is located in any position. In addition, according to the present general inventive concept, filter coefficients or localization filter coefficients of a crosstalk canceller based on various positions of the listener are established as a look-up table in advance, so that a memory can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of reproducing a virtual sound by which a multi-channel audio signal is reproduced as a 2-channel output, the method comprising:

sensing a listener's position and recognizing distance and angle information about the listener's position relative to two speakers;

determining output gain values, delay values, and a filter type index of the two speakers based on the distance and angle information about the sensed listener's position and selecting localization filter coefficients corresponding to the listener's position in a predetermined table using the filter type index; and updating filter coefficients of a localization filter based on the selected localization filter coefficients and adjusting output levels and time delays of the two speakers from the determined gain values and delay values.

2. The method of claim 1, wherein the sensing of the listener's position comprises measuring an angle and a distance of a central position of the two speakers based on a listener.

3. The method of claim 1, wherein the localization filter uses a structure in which a binaural synthesis matrix and a crosstalk canceller matrix are multiplied.

4. The method of claim 1, wherein the determining of the output gain values and the delay values of the two speakers comprises calculating a distance between the listener and the two speakers.

5. The method of claim 1, wherein:

the speakers comprises:

left and right speakers, the output gain values and delay values comprises:

left and right output gains and left and right delay values of the two speakers, and the left and right output gains and the left and right delay values are obtained:

$$g_L = r_2/r_1,\ g_R = r_1/r_2$$

$$\Delta_L = |\text{integer}(F_s(r_2 - r_1)/c)|,\ \Delta_R = |\text{integer}(F_s(r_1 - r_2/c)|,$$

wherein $r_1$ is a distance between the left speaker and a listener, $r_2$ is a distance between the right speaker and the listener, $F_s$ is a sampling frequency, c is sound velocity, and integer is an operator making an integer by rounding off to the nearest integer.

6. The method of claim 1, wherein the selecting of the localization filter coefficients comprises:

establishing a localization filter table in which a binaural synthesis matrix and a crosstalk canceller matrix are multiplied, in advance;

selecting a filter type index corresponding to an angle between the two speakers and the listener; and extracting the localization filter coefficients corresponding to the filter type index.

7. The method of claim 1, wherein the updating of the filter coefficients comprises storing in a filter table coefficients in which the binaural synthesis matrix and the crosstalk canceller matrix that are calculated in various positions of the listener in advance are multiplied in advance.

8. An apparatus to reproduce a virtual sound, comprising:

a position recognition system to sense a listener's position and to measure an angle and a distance between a listener and two speakers;

a parameter converter to extract output gain values and delay values of the two speakers from distance information extracted by the position recognition system and to determine filter type index information that matches angle information from a predetermined filter table; and a virtual sound processor to adjust output levels and time delays of the two speakers from the output gain values and delay values of the two speakers converted by the parameter converter and to update filter coefficients corresponding to the listener's position of a localization filter from filter coefficients corresponding to the filter type index information.

9. The apparatus of claim 8, wherein the parameter converter comprises:

a geometry conversion unit to calculate a geometry relationship between the two speakers and the listener based on the distance and angle information between the two speakers and the listener;

an acoustic model unit to extract output gain values and delay values of the two speakers through acoustic modeling from the distance information calculated by the geometry conversion unit; and a table matching unit to extract a filter type index to select a set of filter coefficients of the localization filter corresponding a listener's position from the angle information calculated by the geometry conversion unit and a predetermined localization filter coefficient table.

10. The apparatus of claim 8, wherein the virtual sound processor comprises:

a filter table in which localization filter coefficients that are calculated in advance and match each of filter type indices are stored;

a virtual sound generator to update filter coefficients of the localization filter from the localization filter coefficients that match the filter type index information and to convert audio signals of two channels into virtual sound sources in a predetermined position; and an output controller to adjust output levels and time delays of signals output from the virtual sound generator based on the output gain values and delay values of the two speakers.

11. The apparatus of claim 10, wherein the virtual sound generator comprises a filter matrix structure in which a binaural synthesis matrix and a crosstalk canceller matrix are multiplied.

12. The apparatus of claim 10, wherein the filter table comprises localization filter coefficients calculated in various positions of the listener.

13. A non-transitory computer-readable recording medium having recorded thereon a program to execute a method of reproducing a virtual sound by which a multi-channel audio signal is. reproduced as a 2-channel output, wherein the program controls the method according to a process comprising:

sensing a listener's position and recognizing distance and angle information about the listener's position relative to two speakers;

determining output gain values and delay values of the two speakers based on the distance and angle information about the sensed listener's position and selecting localization filter coefficients corresponding to the listener's position in a predetermined table; and updating filter coefficients of a localization filter based on the selected localization filter coefficients and adjusting output levels and time delays of the two speakers from the determined gain values and delay values.

14. An apparatus to implement virtual sound based on a listener's position using two speakers, the apparatus comprising:

a geometry conversion unit to calculate a geometry relationship between the two speakers and the listener based on distance and angle information between the two speakers and the listener;

an acoustic model unit to extract output gain values and delay values of the two speakers through acoustic modeling from the distance information calculated by the geometry conversion unit;

a table matching unit to extract a filter type index to select a set of filter coefficients of the localization filter corresponding a listener's position from the angle information calculated by the geometry conversion unit and a predetermined localization filter coefficient table; and a virtual sound processor to receive the output and gain values and the filter type index and to output adjusted audio output signals to the two speakers based on the output and gain values and the filter type index.

15. The apparatus of claim 14, wherein the virtual sound processor comprises:

a filter table to store localization filter coefficients that are calculated in advance and to select at least one of the localization filter coefficients according to the filter type index;

a virtual sound generator to update localization filter coefficients that match the filter type index and to convert audio signals into two channels of virtual sound sources in a predetermined position according to the updated localization filter coefficients; and an output controller to adjust output levels and time delays of signals output from the virtual sound generator based on the output gain values and delay values of the two speakers.

16. The apparatus of claim 15, wherein the virtual sound generator comprises:

a signal correction filter unit to adjust gains and time delays of a left channel signal, a center channel signal, a low frequency effect channel signal, and a right channel signal of the audio signals;

a virtual surround filter unit to lower a correlation between an input left surround channel signal and an input right surround channel signal of the audio signals and to generate a virtual sound source at left and right sides of the listener;

a first addition unit to add the left surround channel signal output from the virtual surround filter unit and the left channel signal output from the signal correction unit and then output an added left signal to one of the two speakers as one of the two channels; and a second addition unit to add the right surround channel signal output from the virtual surround filter unit and the right channel signal output from the signal correction unit and then output the added right signal to the other of the two speakers as the other one of the two channels.

17. The apparatus of claim 16, wherein the virtual surround filter unit comprises:

a preprocessing filter unit to lower the correlation between the input left surround channel signal and the input right surround channel signal, to improve a localization feeling and to simultaneously generate a presence feeling; and a localization filter unit to receive signals output from the preprocessing filter unit, and dispose the virtual sound source at left and right rear sides of the listener so as to generate a surround sound stereo feeling by multiplying a crosstalk canceller matrix and a binaural synthesis matrix corresponding to various positions of the listener to establish the filter table.

18. A method of implementing virtual sound based on a listener's position using two speakers, the method comprising:

calculating a geometry relationship between the two speakers and the listener based on distance and angle information between the two speakers and the listener;

extracting output gain values and delay values of the two speakers through acoustic modeling from the calculated distance information;

extracting a filter type index to select a set of filter coefficients of a localization filter corresponding a listener's position from the calculated angle information; and adjusting output levels and time delays of signals to the two speakers based on the output gain values and delay values and the extracted filter type index.

19. An apparatus to implement virtual sound based on a listener's position relative to two speakers, the apparatus comprising:

a filter table to store a plurality of localization filter coefficients corresponding to the listener's position that are calculated in advance and match each of a plurality of filter type indices;

a virtual sound generator to design a crosstalk canceller in various predetermined positions of a listener relative to the two speakers to convert audio signals into two channels of virtual sound sources according to the filter type indices; and an output controller to adjust output levels and time delays of signals output from the virtual sound generator to the two speakers based on output gain values and delay values of the two speakers.

20. A method of implementing virtual sound based on a listener's position with respect to two speakers, the method comprising:

calculating a plurality of localization filter coefficients;

matching a plurality of filter type indices to the plurality of localization filter coefficients corresponding to the listener's position;

designing a crosstalk canceller to correspond to various predetermined positions of a listener with respect to the two speakers to convert audio signals of two channels into virtual sound sources according to one or more filter type indices; and adjusting output levels and time delays of output signals output to the two speakers based on output gain values and delay values of the two speakers.

* * * * *